US011435094B2

(12) United States Patent
Chiu

(10) Patent No.: US 11,435,094 B2
(45) Date of Patent: Sep. 6, 2022

(54) DEHUMIDIFIER WITH CONTROLLING ASSEMBLY FOR WATER PUMP

(71) Applicant: NEW WIDETECH INDUSTRIES CO., LTD., New Taipei (TW)

(72) Inventor: Ming-Tsung Chiu, New Taipei (TW)

(73) Assignee: NEW WIDETECH INDUSTRIES CO., LTD., New Taipei (TW)

( * ) Notice: Subject to any disclaimer, the term of this patent is extended or adjusted under 35 U.S.C. 154(b) by 297 days.

(21) Appl. No.: 16/909,885

(22) Filed: Jun. 23, 2020

(65) Prior Publication Data

US 2021/0396402 A1 Dec. 23, 2021

(51) Int. Cl.

| | |
|---|---|
| ***F24F 3/14*** | (2006.01) |
| ***F24F 13/20*** | (2006.01) |
| ***F24F 13/22*** | (2006.01) |

(52) U.S. Cl.

CPC ..... *F24F 3/14* (2013.01); *F24F 13/20* (2013.01); *F24F 13/222* (2013.01); *F24F 2003/144* (2013.01); *F24F 2013/227* (2013.01)

(58) Field of Classification Search

CPC .. F24F 3/14; F24F 13/20; F24F 13/222; F24F 2003/144; F24F 2013/227

See application file for complete search history.

(56) References Cited

U.S. PATENT DOCUMENTS

| | | | | |
|---|---|---|---|---|
| 2010/0071399 | A1* | 3/2010 | Yoon | F24F 3/153 62/291 |
| 2020/0011550 | A1* | 1/2020 | Williams | F24F 1/022 |
| 2020/0061531 | A1* | 2/2020 | Yoon | B01D 53/265 |
| 2020/0061532 | A1* | 2/2020 | Yoon | F24F 1/0083 |

FOREIGN PATENT DOCUMENTS

| | | | | |
|---|---|---|---|---|
| CN | 110145818 | A * | 8/2019 | F24F 11/64 |
| CN | 210602097 | U * | 5/2020 | |
| CN | 210892117 | U * | 6/2020 | |
| JP | 3668627 | B2 * | 7/2005 | F24F 3/1423 |
| JP | 2006043523 | A * | 2/2006 | |
| JP | 3919379 | B2 * | 5/2007 | F24F 3/1423 |
| WO | WO-2014058154 | A2 * | 4/2014 | B01D 53/265 |

* cited by examiner

*Primary Examiner* — Kun Kai Ma
(74) *Attorney, Agent, or Firm* — Hershkovitz & Associates, PLLC; Abe Hershkovitz

(57) ABSTRACT

A dehumidifier has a main body and a main tank. The main body has a secondary tank, a water pump, and a controlling assembly electrically connected to the water pump and having a starting position, a stopping position, and a float. The float is located in the secondary tank and is capable of moving with a water level inside the secondary tank. The controlling assembly controls the water pump to start or to stop according to the relative position between the float and the starting position or the stopping position. The main tank is detachably mounted on the main body, is located in a lateral side of the main body, and communicates with the water pump. With the controlling assembly, the water pump can be controlled to start only when necessary, thereby saving energy and reducing noises caused by prolonged running.

10 Claims, 6 Drawing Sheets

DEHUMIDIFIER WITH CONTROLLING ASSEMBLY FOR WATER PUMP

BACKGROUND OF THE INVENTION

1. Field of the Invention

The present invention relates to a home appliance, especially to a dehumidifier.

2. Description of the Prior Arts

An operating principle of a dehumidifier is basically the following: air is drawn into the dehumidifier from the environment via a fan, and then the air passes through a heat exchanger, and thereby moisture in the air is condensed and forms water drops. The water drops are first collected, and then are transported to a tank by a water pump. At the same time, the air that becomes dry and hot is exhausted out of the dehumidifier, so the humidity of the space is decreased.

In a current dehumidifier, the tank is arranged at a bottom part of the dehumidifier and should be separated from a main body of the dehumidifier laterally. However, after the tank is full, the user has to bend over to draw out the tank laterally, and then lifts up the tank.

Because such structure is hard to separate the tank and the main body of the dehumidifier and the full tank is heavy, the aforesaid movement may injure the user's waist or make the tank turned over. Furthermore, under the fierce competition in the current market, the energy consumption and the volume during operation of such household appliances have also become important factors. Therefore, in order to reduce the energy consumption caused by long-time operation and the noises, actuating the water pump only when necessary has become a way in which the dehumidifier can be improved.

To overcome the shortcomings, the present invention provides a dehumidifier with a controlling assembly for a water pump to mitigate or obviate the aforementioned problems.

SUMMARY OF THE INVENTION

The main objective of the present invention is to provide a dehumidifier that has a tank laterally mounted on a main body and the tank can be separated from the main body by upward drawing. Besides, the dehumidifier further has a controlling assembly to control the water pump to actuate only when the water in the secondary tank reaches a certain amount, thereby saving energy.

The dehumidifier has a main body and a main tank. The main body has a radiator, a water collector, a secondary tank, a water pump, and a controlling assembly. The water collector is located under the radiator and has an exhaust hole. The secondary tank is located under the water collector and has a receiving hole and a secondary tank space. The receiving hole is aligned to the exhaust hole of the water collector. The secondary tank space communicates with the receiving hole. The water pump has a drawing opening and a draining opening. The drawing opening communicates with the secondary tank space of the secondary tank. The controlling assembly is electrically connected to the water pump and has a starting position, a stopping position lower than the starting position, and a float. The float is located in the secondary tank space of the secondary tank and is capable of moving upward or downward along with a water level inside the secondary tank space. When the float moves upward and reaches the starting position, the controlling assembly actuates the water pump. When the water pump runs for a first running duration and the float moves downward to a position below the stopping position, the controlling assembly stops the water pump. When the water pump runs for a second running duration, which is longer than the first running duration, and the float is still above the stopping position, the controlling assembly stops the water pump and the main body. The main tank is detachably mounted on the main body and is located in a lateral side of the main body. The main tank is adapted to be moved upward with respect to the main body, thereby detaching from the main body. The main tank has a main tank space. When the main tank is mounted on the main body, the draining opening of the water pump of the main body communicates with the main tank space.

With the secondary tank located under the water collector, the secondary tank can temporally store the dripping water. With the drawing opening of the water pump communicating with the secondary tank and the draining opening of the water pump communicating with the main tank space of the main tank, the water pump can draw the water from the secondary tank to the main tank. Therefore, the main tank may not be restricted by the gravity which limits the structural configuration that the main tank should be mounted at a lower end of a dehumidifier. As a result, the main tank can be mounted beside the main body and can be extracted with a vertical force, so the present invention facilitates ease in operating, prevents the main tank from being turned over, and avoids injuring a user's waist.

Moreover, by electrically connecting the controlling assembly to the water pump, mounting the float in the secondary tank space of the secondary tank, and setting a proper starting position and a proper stopping position, the water pump can be started when the float moves along with the water level in the secondary tank and reaches the starting position, and can be stopped when the float moves along with the water level in the secondary tank and reaches the stopping position. Therefore, the water pump can be controlled to start operating only when necessary by adjusting the starting position and stopping position (for example, started when the water level in the secondary tank reaches 90%, and stopped at 10%), thereby saving energy and reducing noises caused by prolonged running Other objectives, advantages and novel features of the invention will become more apparent from the following detailed description when taken in conjunction with the accompanying drawings.

DETAILED DESCRIPTION OF THE PREFERRED EMBODIMENTS

Figure 1:
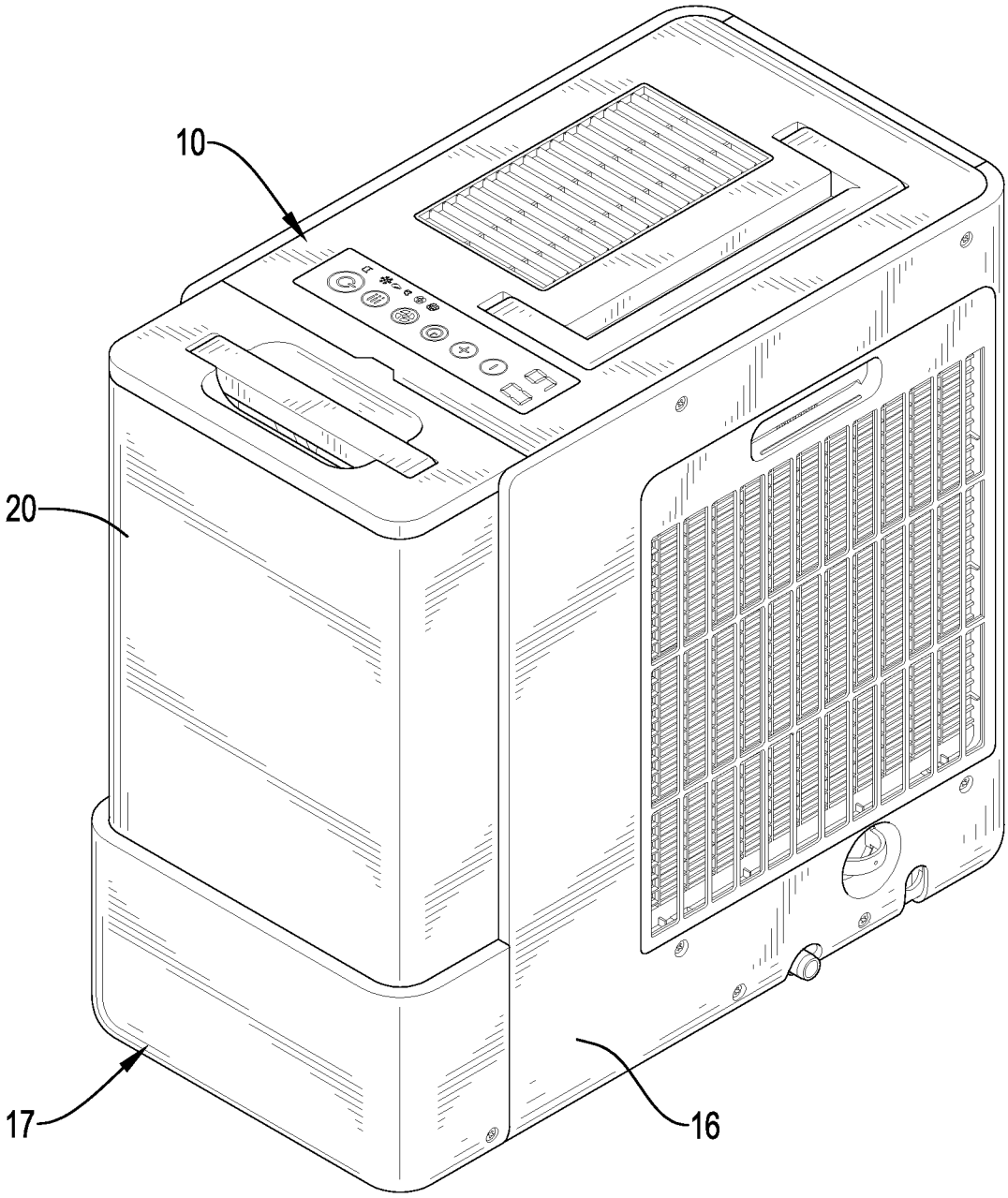
FIG. 1 is a perspective view of a dehumidifier in accordance with the present invention.
Figure 2:
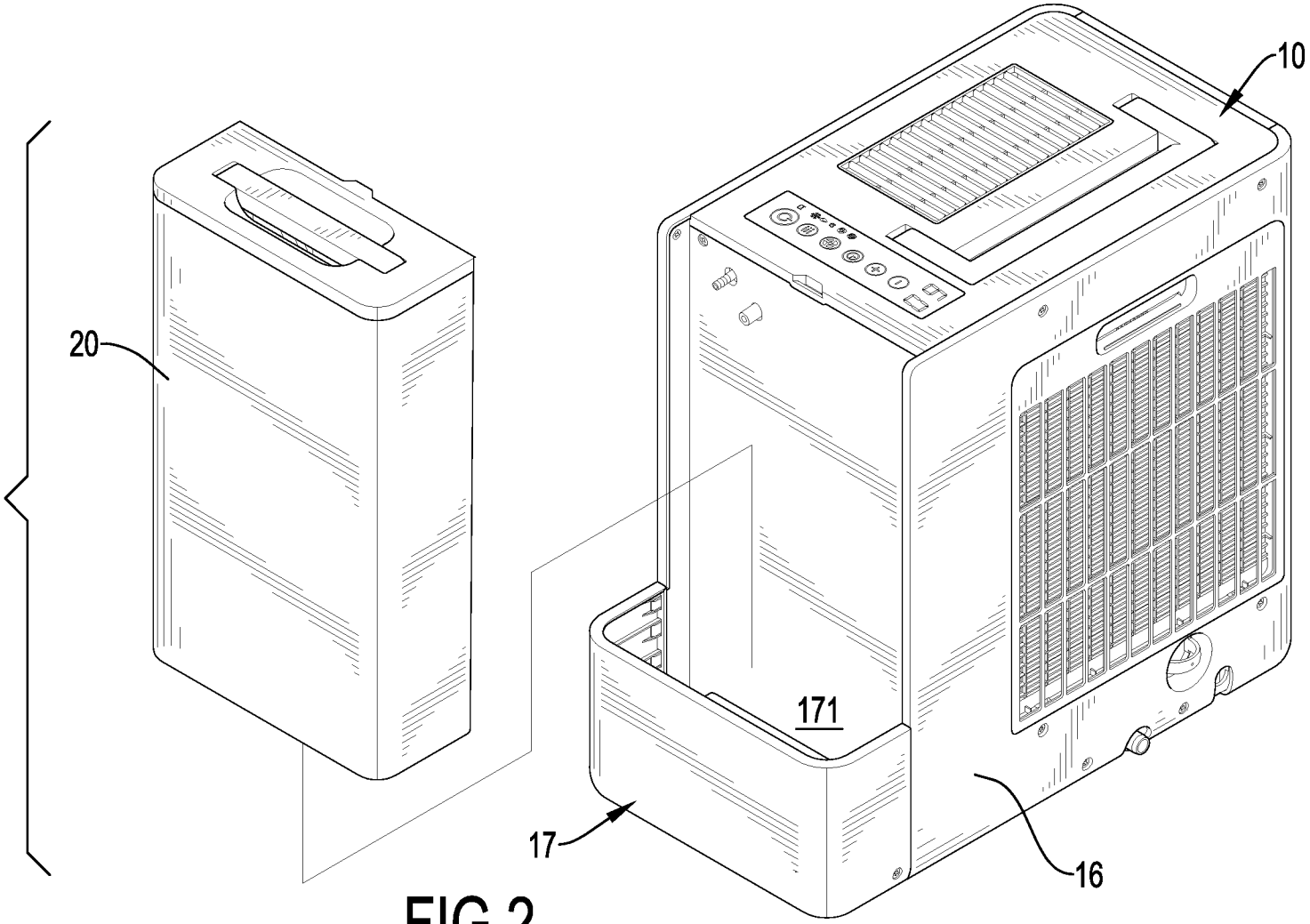
FIG. 2 is a perspective view of the dehumidifier in FIG. 1, showing a main tank detached from a main body.

With reference to FIGS. 1 and 2, a dehumidifier with a controlling assembly for a water pump in accordance with the present invention comprises a main body 10 and a main tank 20.

Figure 3:
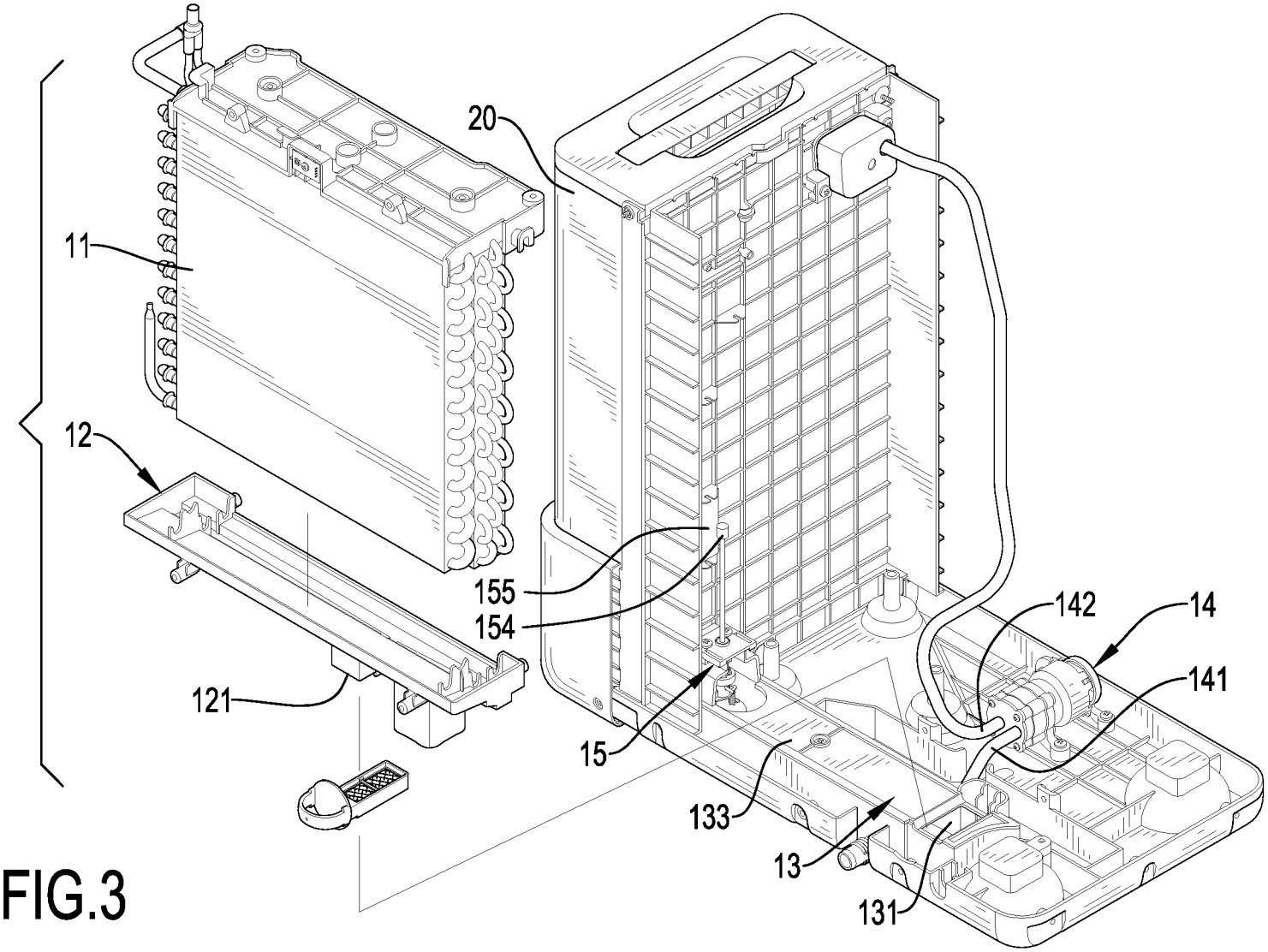
FIG. 3 is an exploded view of the dehumidifier in FIG. 1, showing components inside the main body.
Figure 4:
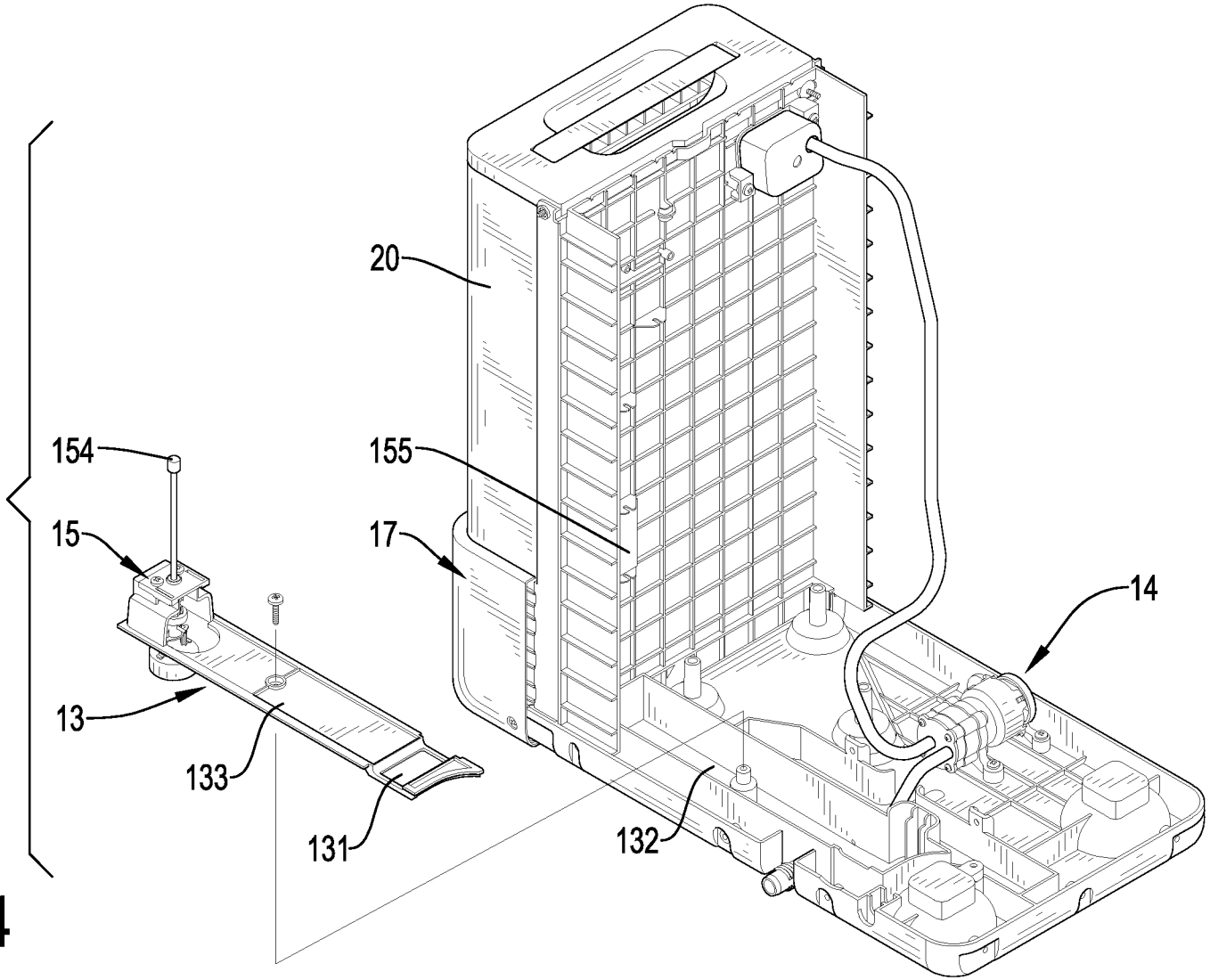
FIG. 4 is another exploded view of the dehumidifier in FIG. 1, showing components inside the main body.

With further reference to FIGS. 2, 3, and 4, the main body 10 has a radiator 11, a water collector 12, a secondary tank 13, a water pump 14, a controlling assembly 15, a housing 16, and an enclosing wall 17.

The water collector 12 is located right under the radiator 11 and has an exhaust hole 121.

Figure 5:
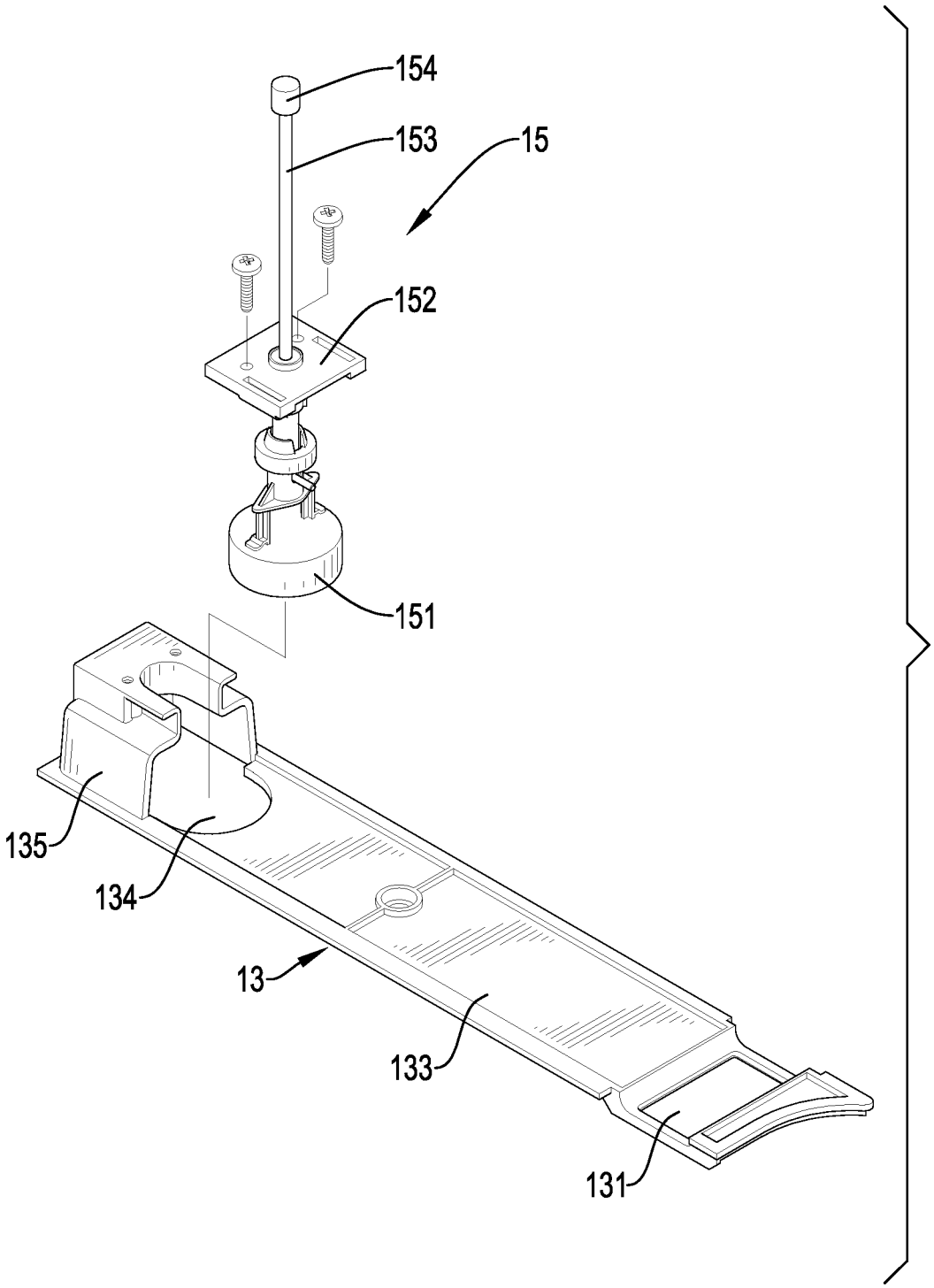
FIG. 5 is still another exploded view of the dehumidifier in FIG. 1, showing the controlling assembly detached from the cover of the secondary tank.
Figure 6:
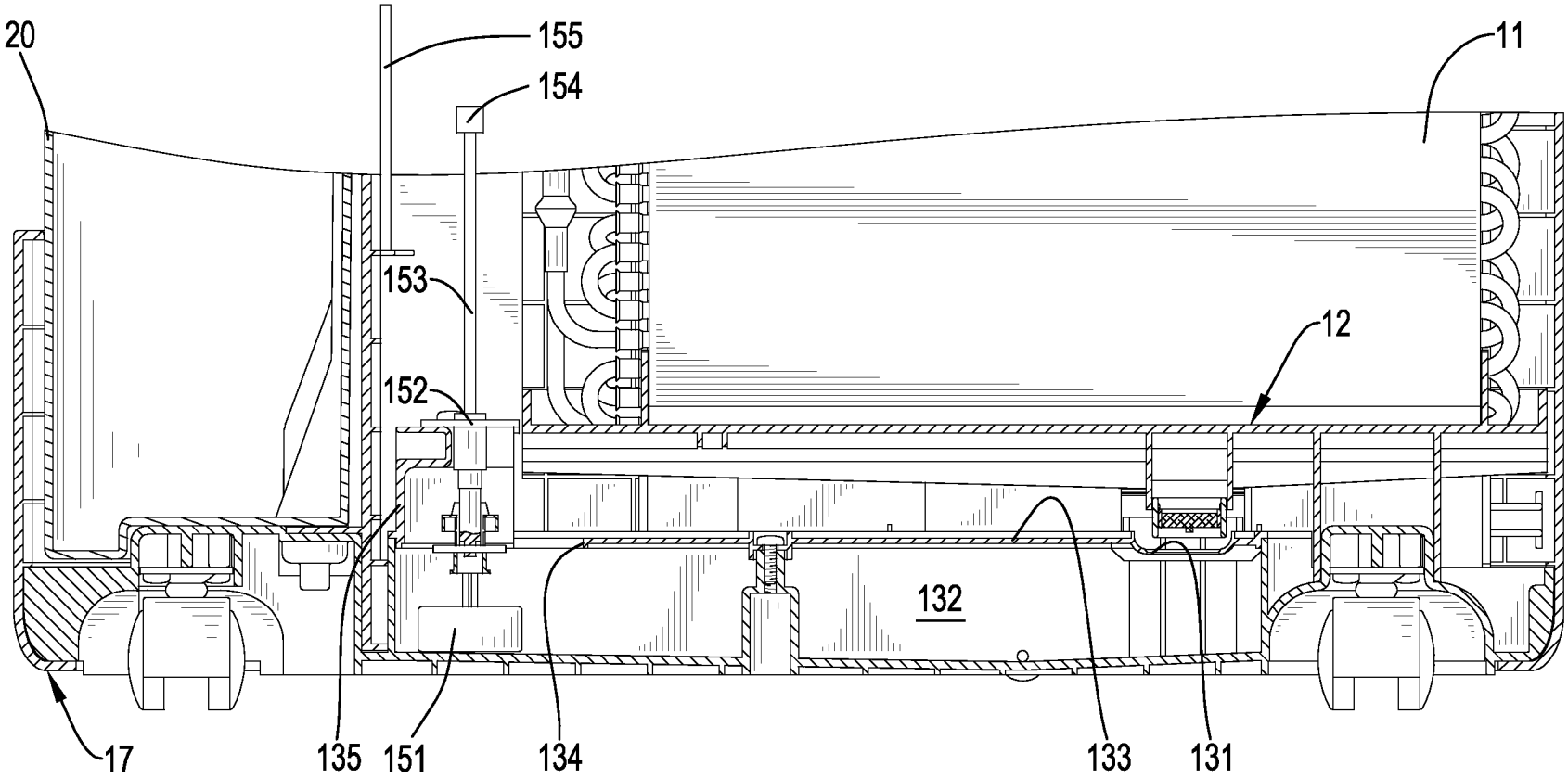
FIG. 6 is a side view in cross section of the dehumidifier in FIG. 1.

With further reference to FIGS. 4, 5, and 6, the secondary tank 13 is located under the water collector 12 and has a secondary tank space 132, a receiving hole 131, a cover 133, a float hole 134, and a mounting base 135.

The receiving hole 131 communicates with the secondary tank space 132 and is aligned to the exhaust hole 121 of the water collector 12. The cover 133 covers the secondary tank space 132, and the receiving hole 131 is formed on the cover 133. The float hole 134 is formed on the cover 133 and communicates with the secondary tank space 132. The mounting base 135 is mounted securely on the cover 133 and extends to an area above the float hole 134.

With further reference to FIG. 4, the water pump 14 has a drawing opening 141 and a draining opening 142. The drawing opening 141 communicates with the secondary tank space 132 of the secondary tank 13.

With further reference to FIGS. 4, 5, and 6, the controlling assembly 15 is electrically connected to the water pump 14 and has a starting position, a stopping position, a float 151, a fixing unit 152, and a position limiting unit 153.

The starting position and the stopping position can be set according to demands. Specifically, two specific values of a water level in the secondary tank 13 are set to start and to stop the water pump 14, respectively. For example, the water pump 14 can be set to start when the water level is higher than 90% of the full water level and to stop when the water level is lower than 10% of the full water level. Thus, normally the stopping position will be lower than the starting position.

The float 151 is located in the secondary tank space 132 of the secondary tank 13 and is capable of moving upward or downward along with the water level inside the secondary tank space 132.

In this embodiment, when the float 151 moves upward and reaches the starting position, the controlling assembly 15 starts the water pump 14. When the water pump 14 runs for a first running duration (a period of time which can be set as desired), and the float 151 moves downward to a position below the stopping position, the controlling assembly 15 stops the water pump. When the water pump 14 runs for a second running duration, which is longer than the first running duration, and the float 151 is still above the stopping position, the controlling assembly 15 stops the water pump 14 and stops the main body 10.

For example, as the water level in the secondary tank 13 reaches 90% (set as the starting position), the controlling assembly 15 starts the water pump 14. After the water pump 14 runs for 10 seconds (set as the first running duration), and the water level decreases to below 10% (set as the stopping position), the controlling assembly 15 stops the water pump 14. If the water pump 14 has run for 10 seconds but the water level is still above 10% (set as the stopping position), the controlling assembly 15 keeps the water pump 14 running After the water pump 14 has run for 30 seconds (set as the second running duration), and the water level is still above 10% (set as the stopping position), the controlling assembly 15 stops the water pump 14, and stops the whole system of the present dehumidifier from running and displays a fault.

Additionally, in this embodiment, the controlling assembly 15 further has a first sensing unit 154 and a second sensing unit 155. The first sensing unit 154 is mounted securely on the position limiting unit 153, is connected to the float 151 via the position limiting unit 153, and is capable of moving along with the float 151. The second sensing unit 155 is mounted securely on an inner wall of the main body 10 and is electrically connected to the water pump 14. The second sensing unit 155 is capable of sensing a position of the first sensing unit 154. By this, the second sensing unit 155 can determine the relative position of the float 151 and the starting position or the stopping position through the first sensing unit 154, and then enables the controlling assembly 15 to perform the corresponding actions described above. Additionally, in this embodiment, the first sensing unit 154 and the second sensing unit 155 are reed switches.

The way in which the controlling assembly 15 controls the water pump 14 is not limited to the abovementioned. For example, in another embodiment, the controlling assembly 15 can be implemented with a toggle switch and a toggling unit. The toggle switch can be mounted securely on any locations and can be electrically connected to the water pump 14. The toggling unit can be mounted securely on the float 151 or the position limiting unit 153. With this, when the float 151 moves to the starting position, the toggling unit abuts and switches the toggle switch, and then the toggle switch starts the water pump 14. When the float 151 moves to the stopping position, the toggling unit again abuts and switches the toggle switch, and then the toggle switch stops the water pump 14.

The fixing unit 152 is mounted securely on the secondary tank 13. Specifically, in this embodiment, the fixing unit 152 is located right above the float hole 134, is mounted securely on the mounting base 135, and is mounted securely on the cover 133.

The position limiting unit 153 is mounted on the fixing unit 152, is capable of moving upward or downward relative to the fixing unit 152, extends into the secondary tank space 132 of the secondary tank 13 via the float hole 134, and is connected to the float 151. With this, the position limiting unit 153 restricts the float 151 to move only upward and downward along with the water level in the secondary tank 13 instead of drifting arbitrarily in the water. Further, the float 151 is selectively mounted through the float hole 134. In other words, the float 151 is allowed to move through the float hole 134; that is, when the water level in the secondary tank 13 approaches a bottom surface of the cover 133, the float 151 moves through the float hole 134 instead of being abutted by the bottom surface of the cover 133 and diving under the water, thereby truly detecting the water level in the secondary tank 13.

The way in which the float 151 is mounted in the secondary tank 13 is not limited to the abovementioned. For example, in another embodiment, the secondary tank 13 can also be implemented without the cover 133, the float hole 134, and the mounting base 135. In this case, the fixing unit 152 of the controlling assembly 15 can be mounted securely on the housing 16 and the position limiting unit 153 extends into the secondary tank 13 to be connected to the float 151. Alternatively, in still another embodiment, the controlling assembly 15 can also be implemented without the fixing unit 152 and the position limiting unit 153, as the float 151 is independently mounted in the secondary tank 13.

With further reference to FIGS.1 and 2, the housing 16 has an outer surface.

The enclosing wall 17 is connected to the housing 16 and is located in a lateral side of the housing 16. The enclosing wall 17 and the outer surface of the housing 16 enclose a receiving space 171 therebetween.

The main tank 20 is detachably mounted on the main body 10 and is located in a lateral side of the main body 10. Specifically, in this embodiment, the main tank 20 is upwardly detachably mounted in the receiving space 171. The main tank 20 is adapted to be moved upward with respect to the main body 10, thereby being detached from the main body 10. The main tank 20 has a main tank space. When the main tank 20 is mounted on the main body 10, the draining opening 142 of the water pump 14 communicates with the main tank space.

With the secondary tank 13 located under the water collector 12, the secondary tank 13 can temporally store the dripping water. With the drawing opening 141 of the water pump 14 communicating with the secondary tank 13 and the draining opening 142 of the water pump 14 communicating with the main tank space of the main tank 20, the water pump 14 can draw the water from the secondary tank 13 to the main tank 20. Therefore, the main tank 20 can be mounted beside the main body 10 and can be extracted with a vertical force, so the present invention facilitates ease in operating, prevents the main tank from being turned over, and avoids injuring a user's waist.

Moreover, by electrically connecting the controlling assembly 15 to the water pump 14, mounting the float 151 in the secondary tank space 132 of the secondary tank 13 and setting a proper starting position and a proper stopping position, the water pump 14 can be started when the float 151 moves along with the water level in the secondary tank 13 and reaches the starting position, and can be stopped when the float 151 moves along with the water level in the secondary tank 13 and reaches the stopping position. Therefore, the water pump 14 can be controlled to start operating only when necessary by adjusting the starting position and the stopping position (for example, started when the water level in the secondary tank 13 reaches 90%, and stopped at 10%), thereby saving energy and reducing noises caused by prolonged running Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dehumidifier comprising:

a main body having a radiator;

a water collector located under the radiator and having an exhaust hole;

a secondary tank located under the water collector and having a receiving hole aligned to the exhaust hole of the water collector; and a secondary tank space communicating with the receiving hole;

a water pump having a drawing opening communicating with the secondary tank space of the secondary tank; and a draining opening; and a controlling assembly electrically connected to the water pump and having a starting position;

a stopping position lower than the starting position; and a float located in the secondary tank space of the secondary tank and being capable of moving upward or downward along with a water level inside the secondary tank space; wherein when the float moves upward and reaches the starting position, the controlling assembly starts the water pump;

when the water pump runs for a first running duration and the float moves downward to a position below the stopping position, the controlling assembly stops the water pump; and when the water pump runs for a second running duration, which is longer than the first running duration, and the float is still above the stopping position, the controlling assembly stops the water pump and the main body; and a main tank detachably mounted on the main body and located in a lateral side of the main body; the main tank adapted to be moved upward with respect to the main body, thereby being detached from the main body; the main tank having a main tank space; wherein when the main tank is mounted on the main body, the draining opening of the water pump of the main body communicates with the main tank space.

2. The dehumidifier as claimed in claim 1, wherein the controlling assembly further has a first sensing unit connected to the float and moving along with the float; and a second sensing unit electrically connected to the water pump and being capable of sensing a position of the first sensing unit.

3. The dehumidifier as claimed in claim 1, wherein the controlling assembly further has a fixing unit mounted securely on the secondary tank; and a position limiting unit mounted on the fixing unit, being capable of moving upward or downward relative to the fixing unit, extending into the secondary tank space of the secondary tank, and connected to the float.

4. The dehumidifier as claimed in claim 2, wherein the controlling assembly further has a fixing unit mounted securely on the secondary tank; and a position limiting unit mounted on the fixing unit, being capable of moving upward or downward relative to the fixing unit, extending into the secondary tank space of the secondary tank, and connected to the float.

5. The dehumidifier as claimed in claim 3, wherein the secondary tank further has a cover covering the secondary tank space; the receiving hole formed on the cover; the fixing unit mounted securely on the cover; and a float hole formed on the cover and communicating with the secondary tank space; the position limiting unit extending into the secondary tank space through the float hole; the float selectively mounted through the float hole.

6. The dehumidifier as claimed in claim 4, wherein the secondary tank further has a cover covering the secondary tank space; the receiving hole formed on the cover; the fixing unit mounted securely on the cover; and a float hole formed on the cover and communicating with the secondary tank space; the position limiting unit extending into the secondary tank space through the float hole; the float selectively mounted through the float hole.

7. The dehumidifier as claimed in claim 5, wherein the secondary tank further has a mounting base mounted securely on the cover and extending to an area above the float hole; and the fixing unit of the controlling assembly is located above the float hole and is mounted securely on the mounting base.

8. The dehumidifier as claimed in claim 6, wherein the secondary tank further has a mounting base mounted securely on the cover and extending to an area above the float hole; and the fixing unit of the controlling assembly is located above the float hole and is mounted securely on the mounting base.

9. The dehumidifier as claimed in claim 1, wherein the main body further has a housing having an outer surface; and an enclosing wall connected to the housing and located in a lateral side of the housing; the enclosing wall and the outer surface of the housing enclosing a receiving space therebetween; and the main tank is upwardly detachably mounted in the receiving space.

10. The dehumidifier as claimed in claim 8, wherein the main body further has a housing having an outer surface; and an enclosing wall connected to the housing and located in a lateral side of the housing; the enclosing wall and the outer surface of the housing enclosing a receiving space therebetween; and the main tank is upwardly detachably mounted in the receiving space.

* * * * *